United States Patent [19]

Boik et al.

[11] Patent Number: 4,504,009

[45] Date of Patent: Mar. 12, 1985

[54] CLOSURE HAVING MEANS FOR RETENTION IN TUBULAR CONTAINER

[75] Inventors: Elmer J. Boik, Lombard; Frederick P. Marshall, Park Forest, both of Ill.

[73] Assignee: The Continental Group, Inc., Stamford, Conn.

[21] Appl. No.: 162,561

[22] Filed: Jun. 24, 1980

[51] Int. Cl.[3] ..... B65D 3/10

[52] U.S. Cl. ..... 229/5.5; 215/355; 220/307; 220/352

[58] Field of Search ..... 229/5.5, 43; 215/354, 215/355, 358, 359, 363, 364; 220/307, 352; 222/145, 565

[56] References Cited

U.S. PATENT DOCUMENTS

| | | | |
|---|---|---|---|
| 2,196,785 | 4/1940 | Takiguchi | 215/355 |
| 2,526,622 | 10/1950 | Martin . | |
| 2,889,967 | 6/1959 | Drenna | 222/565 |
| 2,927,709 | 3/1960 | Hoffman | 215/355 |
| 3,233,775 | 2/1966 | Bozek | 220/307 |
| 3,979,004 | 9/1976 | Bertario | 215/354 |
| 4,223,814 | 9/1980 | Sneider | 222/565 |
| 4,241,864 | 12/1980 | Kessler | 229/5.5 |

FOREIGN PATENT DOCUMENTS

| | | | |
|---|---|---|---|
| 1065903 | 1/1954 | France | 215/355 |
| 1082285 | 7/1955 | France | 215/355 |
| 1351352 | 12/1963 | France | 220/307 |
| 637378 | 3/1962 | Italy | 215/358 |

*Primary Examiner*—William Price
*Assistant Examiner*—Gary E. Elkins
*Attorney, Agent, or Firm*—Charles E. Brown

[57] ABSTRACT

This relates to a closure unit which may be inserted into an open end of a tubular container body, particularly one formed of paperboard or plastic material, and which will have an automatic interlock with the container body and a seal sufficient to hold the closure unit in sealed relation with respect to the container body under all normal usages without the use of adhesive. The interlock between the closure unit and the container body is in the form of a plurality of retaining lugs which are resiliently deflected when the closure unit and container body are assembled and which have a pressure engagement with the interior surface of the container body to form an interlock therewith.

12 Claims, 15 Drawing Figures

40
24
22
30
27
26
20
21
51
48
23
50
53
45
52

24
25
78
83
80
27
32
33
81
82

24
22
25
30
28

50
45
48
52
53
23

22
31
30
38
37
37
24
28
27
35
40

34
35
22
37
38
42
41
44
43
25
32
24
36
27
40
27
27
27
31
27
33

CLOSURE HAVING MEANS FOR RETENTION IN TUBULAR CONTAINER

This invention relates in general to new and useful improvements in containers, and more particularly to end closures for containers having tubular bodies and wherein the end closures snap into the body.

Containers for products have in the past been formed of either plastic tubing or a paper tube and the ends of such containers have been closed by end units or end closures which have a projection which telescopes within the respective container and is secured in place by means of a suitable adhesive. The adhesive, in order to make certain that it is supplied in sufficient quantity to effect the bonding of the closure unit to the container body, normally has a portion thereof disposed on the container body beyond the closure unit. Further, the space between the closure unit and the container body containing the adhesive is also open to the product. When the product is a food, the adhesive becomes a possible contaminant.

In accordance with this invention, it is proposed to provide a closure unit which, when forced into the open end of the container body, sufficiently resiliently engages the interior surface of the container body so as to retain it in place under all use conditions. The closure unit is particularly provided with a plurality of resilient lugs which are automatically cammed radially inwardly when the closure unit is applied to a container body, and the lugs have sufficient resiliency so as to maintain an interlock with the container body.

Although the lugs may be self-supporting, in accordance with this invention the lugs may be pressed by the container body against stop elements so that the anchoring heads of the lugs may be compressibly engaged between the container body and back-up elements.

In accordance with the invention, the lugs sufficiently bear against the inner surface of the container body and form an interlock therewith wherein retention, under test conditions, has been maintained with internal air pressures as high as 60 p.s.i. which is many times the 5–6 p.s.i. normally required.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
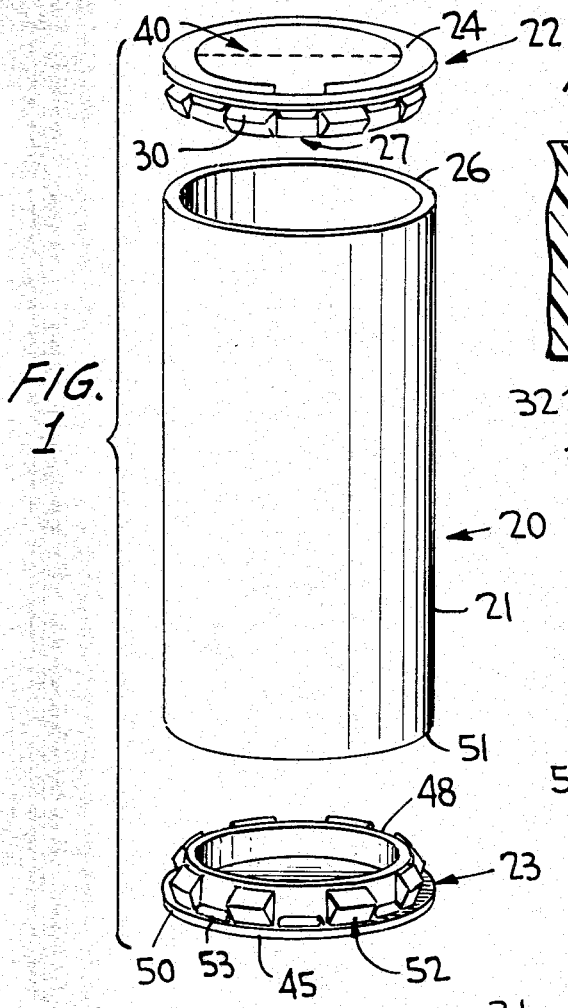
FIG. 1 is an exploded perspective view showing a tubular container body having associated therewith closure units formed in accordance with this invention.

Referring now to the drawings in detail, reference is made to FIG. 1 wherein there are illustrated components of a container formed in accordance with this invention, the container being generally identified by the numeral 20, and including a container body 21 which is provided with an upper end closure, generally identified by the numeral 22, and a lower end closure generally identified by the numeral 23.

It is to be understood that the container body 21 is in the form of a length of tubing. Normally the tube from which the container body 21 is formed will be a conventional spirally wound tube. Accordingly, the constructional details of the container body 21 will not be set forth in more detail here.

With respect to the foregoing, it is also pointed out that the container body 21 could feasibly be formed of a length of plastic tubing.

Figure 2:
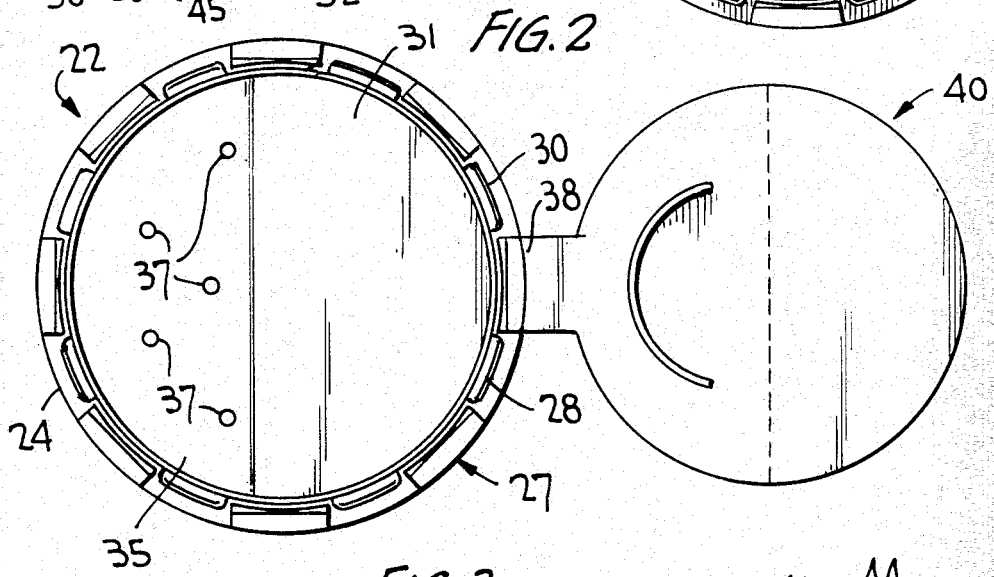
FIG. 2 is an enlarged bottom view of the top closure unit which also is provided with dispensing means.
Figure 3:
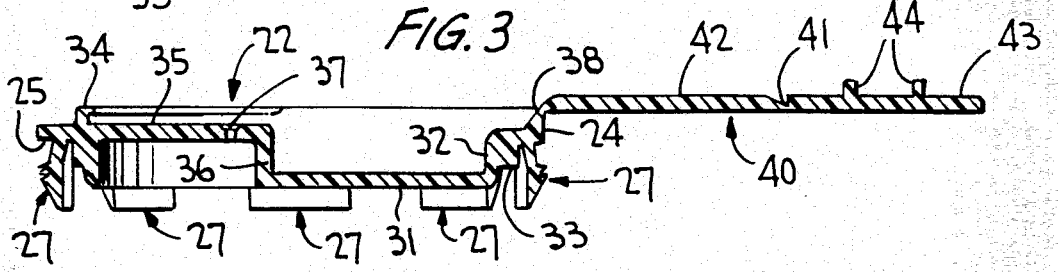
FIG. 3 is an enlarged longitudinal sectional view taken through the closure unit of FIG. 2 generally along the line 3—3.

Referring now to FIG. 2, it will be seen that there is illustrated the closure unit 22 in detail. The closure unit 22, as is also clearly shown in FIG. 3, is of a molded plastics material construction and includes an end panel 24 having formed on its underside a peripheral surface area 25 for engaging an extreme end 26 of the container body and generally forming a seal therewith. The external diameter of the end panel 24 will correspond to the external diameter of the container body 21.

The end panel 24 has depending therefrom a plurality of circumferentially spaced retaining lugs, each identified by the numeral 27. The retaining lugs 27 are separated by separately formed aligning lugs 28 which lie on a common circle and which have radially outer surfaces 30 adapted to be snugly received in an open end of the container body 21.

Figure 4:
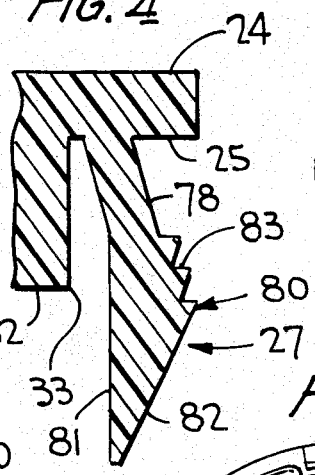
FIG. 4 is an enlarged fragmentary sectional view taken generally along the line 4—4 of FIG. 2, and shows the specific details of one of the retaining lugs.

The closure unit 22 is a dispensing unit, and the end panel 24 has one half thereof axially inwardly offset with the offset end panel portion being identified by the numeral 31 and being in part surrounded by an axial circumferential wall 32 which depends from the end panel 24 and is annular in outline. The wall 32 has an outer corner 33 which is disposed adjacent the retaining lugs 27 as is best shown in FIG. 4 and will be described in detail hereinafter.

The end panel 24 has extending upwardly therefrom an annular projection 34 so as to define a closure element retaining seat arrangement to be described in detail hereinafter.

With particular reference to FIG. 3, it will be seen that the end panel 24 includes a generally half-circular panel portion 35 which lies in the plane of the end panel 24 and which is axially offset from the panel portion 31.

A generally diametrical wall 36 joins diametrically adjacent inner portions of the panel portions 31 and 35.

The panel portion 35 has formed therein suitable dispensing openings 37. The size and shape of these openings, as well as the number, will be varied depending upon the product to be dispensed. The illustrated openings 37 are intended for the dispensing of a powder or fine granular material.

The annular projection 34, remote from the panel portion 35, has hingedly connected thereto as at 38 a closure disk generally identified by the numeral 40. The closure disk is circular in outline and is divided by a hinge line 41 into two generally semicircular portions 42 and 43.

The semicircular portion 43 has projecting therefrom pins 44 which are receivable in the openings 37 to effect the sealing thereof. The portion 42 is intended to overlie the recessed panel portion 31 and the relationship of the closure element 40 to the remainder of the closure unit 22 is one wherein, when the closure unit is sealed closed and one presses down on the panel portion 42, the panel portion 43 will lift upwardly and become disengaged from the panel portion 35. This specific closure action is in no way a part of this invention and is clearly disclosed in the patent to Towns et al, U.S. Pat. No. 3,850,350, granted Nov. 26, 1974. Accordingly, no further details of this feature of the closure unit 22 will be set forth here.

Figure 6:
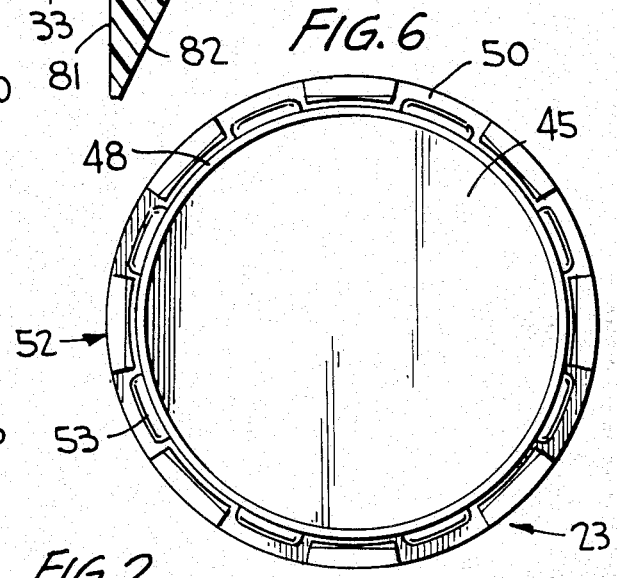
FIG. 6 is an enlarged plan view of the bottom closure unit.

Reference is now made to FIG. 6 wherein it will be seen that the closure unit 23 is of a construction very similar to the closure unit 22, but without the dispensing feature. The closure unit 23 is also preferably molded of a resilient plastics material and includes an end panel 45 having a projecting central portion 46 defined by an annular wall 48.

The upper side of the end panel 45 around the periphery of the end panel is in the form of a surface area 50 for engaging in abutting relation the extreme lower end 51 of the container body 21 generally in sealed relation. The end panel 45 has projecting therefrom in circumferentially spaced relation retaining lugs, generally identifed by the numeral 52, and aligning lugs 53 which correspond substantially to the lugs 27 and 28.

Figure 7:
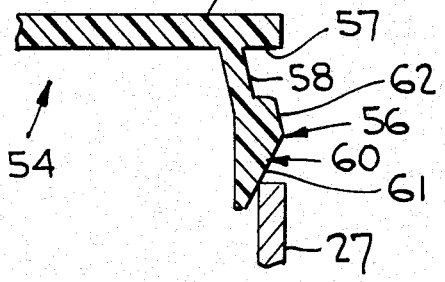
FIG. 7 is an enlarged fragmentary sectional view taken through a modified form of closure unit.
Figure 8:
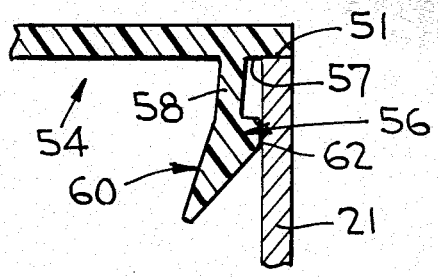
FIG. 8 is a sectional view similar to FIG. 7, and shows the closure unit assembled with a tubular container body.

Rather than to describe the manner in which the closure units 22, 23 are interlocked with the container body 21, reference is now made to FIGS. 7 and 8 wherein there is schematically illustrated the details of the simplest form of closure unit formed in accordance with this invention, the closure unit being generally identified by the numeral 54. The closure unit 54 includes a circular outline end panel 55 which has depending therefrom at circumferentially spaced intervals retaining lugs 56 which are similar to the lugs 27 but may have a configuration different therefrom. An annular portion of the end panel 55, radially outwardly of the connections of the lugs 56 to the end panel 55, defines a surface area 57 by abutting an extreme end of a tubular container body.

It is to be noted that the retaining lug 56 has a thin strap-like portion 58 which is directly integral with the end panel 55, and an anchoring head, generally identified by the numeral 60. The anchoring head 60 has a cam surface 61 facing away from the end panel 55 and sloping generally toward the plane of the end panel 55 and radially outwardly with respect thereto. The head 60 also has an anchoring surface 62 which is disposed generally radially outermost and slopes toward the plane of the end panel 55 and radially inwardly. The other surfaces of the anchoring head 60 have no function in this embodiment of closure unit.

With reference to FIGS. 7 and 8, it will be seen that the relative diameters of the surface 61 and the intended container body 21 is such that the extreme end of the container body, for example the end 51, will engage the cam surface and as the closure unit 54 is pressed into the container body 21, the lugs 56 will be radially inwardly deflected until they reach a position where they will pass through the container body 21, after which the closure unit 54 and the container body 21 are telescoped sufficiently to have the extreme end 51 abut the surface 57, as is clearly shown in FIG. 8.

Due to the resiliency of the lugs 56, the lugs will tightly press the anchoring surface 62 of each lug against the inner surface of the container body. Further, when the container body 21 is formed of a relatively soft and deformable material such as paperboard or plastic, the lugs 56 will have a tendency to impress the material of the container body and form anchoring interlocks therewith.

The anchoring surface 62 may either be relatively smooth, as shown in FIG. 7, or may be generally serrated, as is shown with respect to the lugs 27 which are to be described in more detail hereinafter.

Although the closure unit 54 has been illustrated and described hereinabove with only projecting retaining lugs 56, it is to be understood that if desired between adjacent retaining lugs there may be guide lugs such as the lugs 28.

Figure 9:
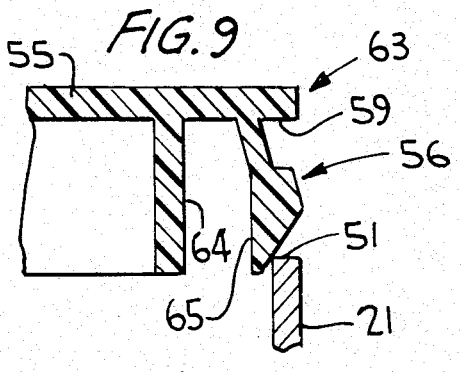
FIG. 9 is a fragmentary sectional view similar to FIG. 7, showing another form of closure unit.
Figure 10:
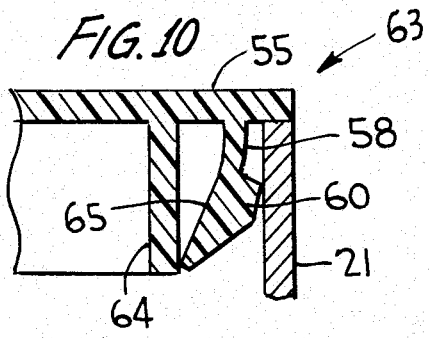
FIG. 10 is a fragmentary sectional view through the closure unit of FIG. 9, and inserted within a tubular container body.

Referring now to FIG. 9, it will be seen that there is illustrated still another form of closure generally identified by the numeral 63. The closure 63 is identical with the closure unit 54 with the addition of a pressure ring 64 disposed radially inwardly of the lugs 56. The closure unit 63 is assembled with a container body 21 in the same manner as described with respect to the closure unit 54. However, as is clearly shown in FIG. 10, when the lugs 56 are deflected radially inwardly sufficiently to be received within the container body 21, radially inner surfaces 65 of the lugs 56 will have engaged the pressure ring 64 which functions as a back-up for the lugs 56. Thus, the pressure exerted radially outwardly by each of the retaining lugs 56 on the inner surface of the container body is not restricted to the resiliency of the strap portion 58, and thus the closure unit 63 may be more firmly anchored within the container body.

Figure 11:
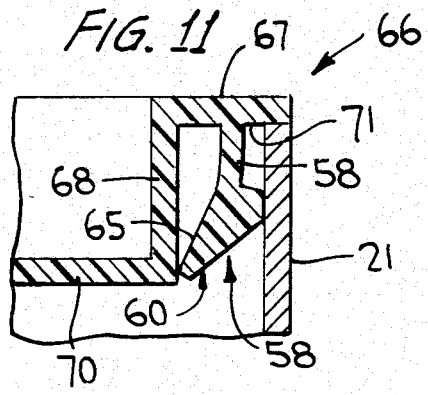
FIG. 11 is a sectional view taken through the closure unit of FIG. 6 when applied to a tubular container body.

Reference is now made to FIG. 11 which could be a cross section of the closure unit 23 although it does not necessarily have the guide lugs 53. The closure unit in FIG. 11 is generally identified by the numeral 66 and includes an annular end panel 67 having projecting from the radially inner portion thereof an annular wall 68 which, in turn, carries an axially offset inner end panel portion 70. The end panel 67 also has projecting therefrom in the same axial direction as the wall 68 and in surrounding relation to the wall 68 a plurality of circumferentially spaced anchoring lugs 56. The connections between the strap 58 of the lugs 56 and the end panel are surrounded by a radially outer peripheral surface 71 which, like the surface 57, is intended to abut the extreme end of the container body 21.

The anchoring lugs 56 function in the same manner as that described with respect to the closure units 54 and 63 except that the annular wall 68 has the further function of being a back-up for the lugs 56 and may extend axially beyond the radially inner surface 65 of the lugs 56 so that the lugs 56 engage an intermediate portion of the wall 68 for its back-up support.

Figure 12:
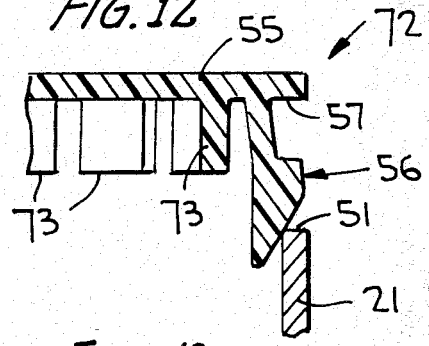
FIG. 12 is a sectional view similar to FIG. 7, and shows yet another form of closure unit.
Figure 13:
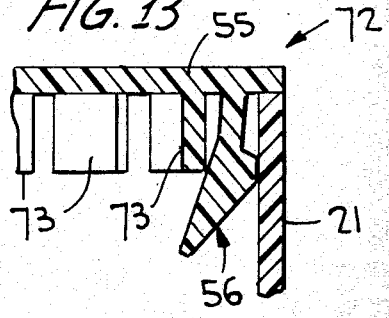
FIG. 13 is a sectional view through the closure unit of FIG. 12, applied to a tubular container body.

Reference is now made to FIGS. 12 and 13, wherein it will be seen that there is illustrated another closure unit generally identified by the numeral 72. The closure unit 72 may be identical with the closure unit 54 and will differ therefrom only in that there is projecting from the end panel 55 in the same axial direction as the retaining lugs 56 a plurality of back-up lugs 73, there being one backup lug 73 for each of the lugs 56 and, if desired, the backup lugs 73 may be of a lesser circumferential extent than the retaining lugs 56.

Referring now to FIG. 13, it will be seen that when the closure unit 72 is positioned within an end of the container body 21, the radially inner surface 65 of each lug 56 will engage its respective back-up lug 73 substantially in the same manner as does the lug 56 of the closure unit 63 with respect to the annular wall 64. The individual back-up lugs 73 have the added advantage of providing for controlled resiliency, and thus controlled back-up support pressure on the retaining lugs 56.

Figure 14:
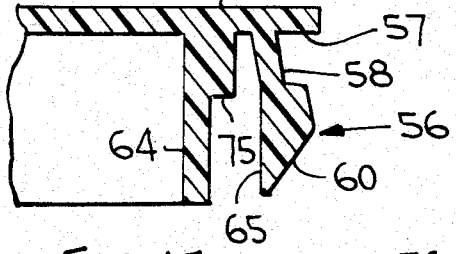
FIG. 14 is a fragmentary sectional view similar to FIG. 7, and shows still another form of closure unit.

Referring now to FIG. 14, it will be seen that the illustrated closure unit, generally identified by the numeral 74, is identical with the closure unit 63 except that the annular wall 64 is provided with individual back-up lugs 75 adjacent the connection of the wall 64 to the end panel 55. The axial extent of the lugs 75 will control the point at which they engage the surface 65 of the lugs 56 and this, in combination with the resiliency of the lugs 56, will control the pressure engagement of the anchoring heads 60 with the inner surface of the container body. It is also feasible that the lugs 56 be so proportioned that the surfaces 65 thereof will engage both the lugs 75 and the ring or wall 64.

Figure 15:
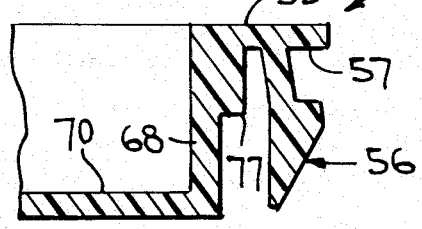
FIG. 15 is a sectional view similar to FIG. 7, and shows yet another form of closure unit.

A further closure unit, generally identified by the numeral 76, is illustrated in FIG. 15. This closure unit corresponds to the closure unit 66 and differs therefrom only in that the wall 68 has formed integrally therewith back-up lugs 77 which correspond to the back-up lugs 75 of FIG. 14. The back-up lugs 77 function in the same manner as the backup lugs 75 and no further description of the operation thereof is believed to be necessary.

Figure 5:
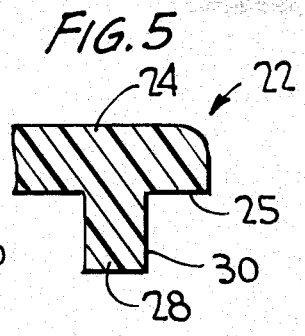
FIG. 5 is a fragmentary enlarged sectional view taken generally along the line 5—5 of FIG. 2, and shows the details of a typical centering lug.

Reference is now specifically made to FIGS. 4 and 5.

First, with respect to FIG. 5, it will be seen that the guide or aligning lugs 28 are relatively short as compared to the lugs 27 and serve to position and center the extreme end of the container body 21 relative to the end panel 24.

Referring now to FIG. 4, it will be seen that the lugs 27 are of a construction similar to that of the lugs 56 and in fact the lugs 56 could be of an identical configuration to that of the lugs 27. It is, of course, pointed out here that the lug 27 illustrated in FIG. 4 is the preferred lug embodiment, and therefore will be described most specifically here. The lug 27 includes a strap portion 78 which is integrally connected to the end panel 24 immediately adjacent the area 25 and generally along the same circle as the lugs 28. The strap extends axially from the end panel 24 and radially outwardly so as partially to intersect with an axial projection of the surface 25.

Each lug 27 also includes an anchoring head, generally identified by the numeral 80. The anchoring head 80 is generally triangular in cross section and has a radially inner rear surface 81 which is part of a cylinder. It also has a cam surface 82 which is part of a cone and which slopes axially toward the plane of the end panel 24 and radially outwardly. The surface 82 is at least in part aligned with an axial projection of the surface 25 so that it will engage in camming relation the extreme end 26 of the container body 21 and thus will effect the camming of the lug 27 radially inwardly so that it will enter the container body.

The anchoring head 80 also has a radially outer part 83 disposed adjacent the strap 78 and forming an anchoring surface for engaging the internal surface of the container body 21. The part 83 is of a serrated construction so that it will dig into the container body and form a strong mechanical interlock therewith and thus further resist displacement of the closure unit 22 relative to the container body 21.

As mentioned above, the interlock between the various closure units and a tubular container body, preferably one formed of paperboard, is such that an effective seal can be obtained between the container body and the closure unit which will withstand an internal air pressure as high as 60 p.s.i. which greatly exceeds the required 5–6 p.s.i. Accordingly, the closure units of this invention have a holding power which greatly exceeds that required, and therefore no adhesive is required to hold the closure unit in place, thereby eliminating the possible contamination of a food product by the adhesive.

Although a number of forms of closure units in accordance with this invention have been specifically illustrated and described, it is to be understood that minor variations may be further made in the closure units without departing from the spirit and scope of the invention as defined by the appended claims.

We claim:

1. An end closure for tubular container bodies, said end closure comprising an end panel having axially inner and outer surfaces, said axially inner surface including a peripheral radially outer surface area for engaging in abutting relation an extreme end of a container body, and retaining means projecting from said axially inner surface, said retaining neans being in the form of peripherally spaced lugs, each of said lugs having a separate resilient connecting portion joined to said end panel within the confines of said peripheral area, each of said lugs including an anchoring head carried by said connecting portion and having a cam surface adjacent a free end thereof for engagement with a container extreme end to position said lugs, said cam surface having a radially inner portion thereof lying within an axial projection of said peripheral surface, said anchoring head also including a roughened anchoring surface lying intermediate said cam surface and said connecting portion and generally lying within said axial projection of said peripheral surface and a depending centering lug disposed between each pair of said lugs.

2. An end closure according to claim 1 wherein said centering lugs lie along a common circle.

3. An end closure for tubular container bodies, said end closure comprising an end panel having axially inner and outer surfaces, said axially inner surface including a peripheral radially outer surface area for engaging in abutting relation an extreme end of a container body, and retaining means projecting from said axially inner surface, said retaining means being in the form of peripherally spaced lugs, each of said lugs having a separate resilient connecting portion joined to said end panel within the confines of said peripheral area, each of said lugs including an anchoring head carried by said connecting portion and having a cam surface adjacent a free end thereof for engagement with a container extreme end to position said lugs, said cam surface having a radially inner portion thereof lying within an axial projection of said peripheral surface, said anchoring head also including a roughened anchoring surface lying intermediate said cam surface and said connecting portion and generally lying within said axial projection of said peripheral surface, and back-up means for said lugs to limit radial inward movement thereof.

4. An end closure according to claim 3 wherein the radial inward movement is limited to a position wherein said anchoring surface primarily remains within said axial projection of said peripheral surface.

5. An end closure according to claim 4 wherein at least one of said back-up means and said anchoring head are resiliently compressible.

6. An end closure according to claim 3 wherein said back-up means are in the form of a continuous ring.

7. An end closure according to claim 3 wherein said back-up means include a separate back-up member for each lug.

8. An end closure according to claim 3 wherein said back-up means are in the form of a continuous ring projecting from said end panel and a separate back-up member for each lug disposed radially outwardly of said ring generally at said end panel.

9. An end closure according to claim 3 wherein said back-up means are in the form of a continuous ring defining a recessed cavity in said end panel including a recessed end panel portion.

10. An end closure according to claim 3 wherein said back-up means are in the form of a continuous ring defining a recessed cavity in said end panel including a recessed end panel portion, said recessed end panel portion having at least one dispensing opening therein.

11. An end closure according to claim 3 together with an open ended tubular container, said lugs being telescoped within one end of said tubular container and compressively engaging a radially inner surface of said tubular container, and said end panel closing said one container one end with said peripheral axially inner surface area engaging an extreme end of said tubular container, said anchoring heads being compressed between said back-up means and said container radially inner surface.

12. An end closure and container assembly as defined in claim 11 wherein there is disposed between each pair of said lugs a depending centering lug, said centering lugs generally defining said peripheral outer surface area of said end panel and being telescoped within said container one end in centering relation.

* * * * *